United States Patent [19]

Graff

[11] 4,395,653

[45] Jul. 26, 1983

[54] ELECTRIC LAMP WITH NEODYMIUM OXIDE VITREOUS COATING

[75] Inventor: William A. Graff, Willoughby, Ohio

[73] Assignee: General Electric Company, Schenectady, N.Y.

[21] Appl. No.: 276,976

[22] Filed: Jun. 24, 1981

[51] Int. Cl.[3] ..... H01K 1/32

[52] U.S. Cl. ..... 313/112; 313/116

[58] Field of Search ..... 313/112, 116

[56] References Cited

U.S. PATENT DOCUMENTS

| | | | |
|---|---|---|---|
| 1,900,463 | 3/1933 | Pipkin | 313/116 X |
| 2,660,531 | 11/1953 | Fraser et al. | 106/48 |
| 2,877,139 | 3/1959 | Hyde et al. | 313/116 X |
| 3,005,722 | 10/1961 | Cerulli | 106/54 |
| 3,320,460 | 5/1967 | Bouchard et al. | 313/112 |
| 4,081,709 | 3/1978 | Collins et al. | 313/116 |
| 4,224,074 | 9/1980 | Reade | 106/48 |
| 4,315,186 | 2/1982 | Hirano et al. | 313/112 X |

*Primary Examiner*—Palmer C. Demeo

*Attorney, Agent, or Firm*—John F. McDevitt; Philip L. Schlamp; Fred Jacob

[57] ABSTRACT

Selective light absorption coatings are provided for electric lamps which comprise a transparent vitreous frit containing neodymium oxide to selectively absorb radiation in the green and yellow wavelength region of the visible spectrum while transmitting the remaining visible radiation. A preferred vitreous frit is zinc borosilicate glass containing neodymium oxide which can be fired as an enamel coating on the exterior surface of the soda-lime glass envelope customarily employed for incandescent lamps. In a different preferred embodiment, the transparent vitreous frit containing neodymium oxide is admixed with an inorganic particulate filler and said mixture electrostatically deposited on the interior surface of the lamp glass envelope.

13 Claims, 1 Drawing Figure

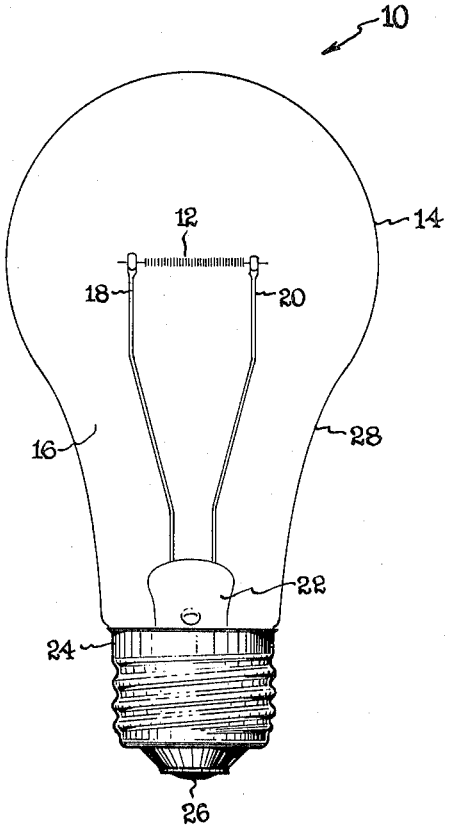
10
12
14
18
20
16
28
22
24
26

ELECTRIC LAMP WITH NEODYMIUM OXIDE VITREOUS COATING

BACKGROUND OF THE INVENTION

Various coatings are known which can be applied to electric lamps for different purposes. For example, light diffusion coatings are used to hide the incandescent filament of an incandescent lamp and which are often applied as a fired enamel or as an electrostatic deposit of colloidal powders. Other colored enamels and electrostatic coatings have been used for quite some time to produce either clear or opaque light transmission of a different color than the emission color of the light source in the electric lamp.

One light diffusing coating of this type is described in U.S. Pat. No. 4,081,709, issued to the assignee of the present invention, which pertains to an electrostatic coating of silica on the inner bulb wall of an electric lamp and which is obtained by controlling the particle size and electrical resistivity of the silica powder. The light diffusion produced in this manner completely hides the lamp filament or other internal lamp structure with little light loss and the aforementioned physical characteristics of the silica powder permit electrostatic deposition to be carried out reliably under varying environmental conditions.

In still pending application Ser. No. 239,595, filed Mar. 2, 1981, in the names of C. B. Collins and W. G. James, and also assigned to the present assignee, there is disclosed an electrostatically deposited coating which produces colored emission from an incandescent lamp through selective light absorption by a particulate opaque colorant in the powder mixture used. This selective light absorption provides effective filtering means whereby the balance of visible radiation produced by the light source is emitted from the lamp with little light loss. The desired effect is produced with a powder mixture utilizing light refractive particles, a selective light absorption particulate colorant, and flux calcined diatomaceous silica with said powder mixture also having a particular particle size range and electrical conductivity characteristic for electrostatic deposition. Useful light refractive particles in said powder mixture can be selected from the group consisting of alumina, silica, aluminosilica, calcium carbonate, and mixtures thereof. A uniform yellow color lamp emission can be obtained with said coating which absorbs blue color radiation in the 390–500 nanometer wavelength region by reason of the absorption characteristics of the particulate colorant material being used.

In the co-pending application Ser. No. 276,975, filed June 24, 1981, now U.S. Pat. No. 4,359,536, also assigned to the present assignee, there is described a frit glass composition which is particularly useful to color the soda-lime glass envelope of incandescent lamps. Specifically, the disclosed glass frit comprises a zinc borosilicate glass composition containing various colored oxides to produce a colored coating when fired on the surface of the lamp glass envelope. Said glass frit has a composition expressed in terms of weight percent, based on the starting batch formulation, as follows: 25–30 ZnO, 12–18 $SiO_2$, 24–35 $B_2O_3$, 1–3 $Al_2O_3$, 5–10 $Na_2O$, 7–8 CaO, 2–5 BaO, 0.5–3 $ZrO_2$, 1–2 F, and 0–6 $K_2O$ except for incidental impurities and refining agents. Typical proportions of inorganic pigment used to produce transparent colored light emission from the coated lamps is said to reside in the range 0.3 to 2.0 weight percent of the total composition.

It would be a desirable to selectively absorb some of the green and yellow radiation emitted from electric lamps while still transmitting the remaining visible light. A pleasant aesthetic result is thereby produced wherein skin tones and other objects being illuminated by the lamp radiation appear more pink in color. Thus, visible radiation from an uncoated incandescent lamp can be improved since the yellow color light causes some skin tones to take on a sallow appearance. It would be further desirable to achieve said objective by means not requiring that the lamp glass envelope itself be modified, however, in order to minimize the cost and impact upon lamp manufacture.

SUMMARY OF THE INVENTION

It has now been discovered, that a novel zinc borosilicate frit glass containing neodymium oxide can be applied as a coating on the surface of the lamp glass envelope in various electric lamps to provide selective absorption of the visible light being emitted by the light source in the green and yellow wavelength region. More particularly, it has been found that a coating containing said glass frit on either surface of the lamp glass envelope can selectively absorb radiation being emitted by the light source and thereby produce the aforementioned color change in lamp emission without undue light loss. Surprisingly, it has not been found possible to achieve comparable results with coatings containing neodymium oxide as a discrete material rather than in solution in a glass frit. Discrete neodymium oxide dispersed in coatings was found to produce only non-selective light loss hence not imparting the desired color change in lamp emission. The present dispersions produce two unique absorption doublets attributed to neodymium in the visible region with one doublet occuring at 510 and 530 nanometers wavelength in the green region while the other occurs at 570 and 585 nanometers wavelength in the yellow region. Although this desired filtering can otherwise be achieved by having neodymium oxide dispersed in the glass material forming the lamp glass envelope to obviate need for any coating on the lamp glass envelope, such a modification would require the melting of a specially formulated bulb glass with the associated added expense of melting and forming equipment as well as consumption of a larger quantity of neodymium oxide and energy.

Basically, the present invention thereby comprises an electric lamp which includes a light transparent glass envelope, a visible light source located within said envelope, and a coating having neodymium oxide melted into a transparent vitreous frit being deposited on the surface of said envelope to selectively absorb green and yellow radiation emitted from said light source. In its preferred embodiments, said selective light absorption is achieved without significant reduction in the remaining light emission from the electric lamp and the coatings are of a specific form depending upon the particular surface of the lamp glass envelope where located. A preferred coating on the outer surface of the said lamp glass envelope is achieved by firing the novel zinc borosilicate glass composition containing neodymium oxide directly on the outer bulb wall of a soda-lime glass incandescent lamp envelope. A different preferred embodiment utilizes a similar glass frit mixed with powdered silica and electrostatically deposits this mixture on the inner bulb wall of the incandescent lamp envelope. In contrast thereto, the fired coating on the outer bulb wall produces a glossy and transparent final product which should experience less overall light reduction from the lamp caused by light reflection.

A suitable silica powder to mix with the present glass frit for subsequent electrostatic deposition on the inner bulb wall of an electric lamp is described in the abovementioned pending application Ser. No. 239,595. The present glass frit in powder form replaces the colorant employed in said prior art powder mixture in weight proportions dictated by the particular color point and light output characteristics desired in the coated lamp. Accordingly, one preferred electrostatic powder mixture in accordance with the present invention comprises approximately 60 weight percent of neodymium oxide containing zinc borosilicate glass frit with approximately 40 weight percent of a silica powder containing diatomaceous silica, fumed silica light refractive particles, and silica fluidizing agent, which is applied to the inner bulb wall in the same manner also disclosed in said pending application.

Suitable neodymium oxide frit glass compositions for use as a fired coating on soda-lime glass lamp envelopes comprise in approximate weight percent: 10–20 ZnO, 8–20 $SiO_2$, 15–20 $B_2O_3$, 0–2 $Al_2O_3$, 30–40 $Nd_2O_3$, 1–2 $Na_2O$, 6–8 $K_2O$, 0–5 BaO, 0–5 CaO, 1–3 $ZrO_2$, and 1–3 F except for residual impurities and refining agents. The average thermal coefficient of expansion for such preferred glass frit lies in the range of 75 to $94\times10^{-7}$/°C. over a 0°–300° C. temperature range to match the thermal expansion characteristics of soda-lime glass and said frit glass exhibits viscosity-temperature characteristics amenable to firing the coating without distorting the underlying glassware. A preferred glass frit meeting the foregoing criteria consists essentially of, in weight percent:

| | |
|---|---|
| ZnO | 14 |
| $SiO_2$ | 20 |
| $B_2O_3$ | 18 |
| $Nd_2O_3$ | 36 |
| $Na_2O$ | 2 |
| $K_2O$ | 6 |
| $ZrO_2$ | 2 |
| F | 2 |

except for incidental impurities and refining agents. Mixing this frit glass in powder form with a conventional organic suspending liquid provides a slurry suitable for deposition and firing on the soda-lime glass envelope surface to produce the final desired glossy transparent coating.

A larger weight proportion of neodymium oxide is required in the above type zinc borosilicate glass frit for use as an electrostatically deposited coating on the inner bulb wall of an incandescent lamp. The relatively thin coatings obtained in this manner produce insufficient light absorption in the green and yellow color region at a neodymium oxide level below about 40%–70% weight percent in the frit glass composition. Increasing the neodymium oxide level above about 70% in this glass composition is undesirable, however, by reason of an observed tendancy for devitrication when the glass is quenched in water after melting to produce the frit. On the other hand, this substantial increase of the neodymium oxide constituent in the glass frit surprisingly did not materially lower the light output from an incandescent lamp more than was obtained with a fired coating of glass frit containing 36% neodymium oxide by weight. Accordingly, suitable neodymium oxide containing glass frits for an electrostatic coating comprise in approximate weight percent: 7–15 ZnO, 8–18 $SiO_2$, 9–19 $B_2O_3$, 0–2 $Al_2O_3$, 40–70 $Nd_2O_3$, 0–1 $TiO_2$, 1–2 $Na_2O$, 2–6 $K_2O$, 0–1 $ZrO_2$, and 1–3 F except for residual impurities and refining agents. The preferred glass frits for electrostatic deposition contain about 60–70 weight percent neodymium oxide to provide equivalent light absorption as compared with a fired coating of the previously described glass frit containing about 36% neodymium oxide by weight.

BRIEF DESCRIPTION OF THE DRAWING

The accompanying drawing depicts a conventional incandescent lamp having the present neodymium oxide containing coating fired on the exterior surface of the lamp glass envelope.

DESCRIPTION OF THE PREFERRED EMBODIMENTS

Referring now to the accompanying drawing, an illustrative incandescent lamp 10 is shown having an incandescent light source 12 in the form of a tungsten resistive coil being disposed in a horizontal position. As therein illustrated, the lamp is of conventional design comprising a sealed soda-lime glass envelope 14 containing said resistive lamp filament 12 having its ends secured to in-lead support means 16 in the form of a pair of lead-in conductors 18 and 20 which have portions thereof hermetically sealed in the press or pinch portion 22 of the lamp envelope. Additionally, said lead-in conductors 18 and 20 extend to a metal shell member 24 having an eyelet 26 which forms a screw type base for the incandescent lamp. A gas filling or vacuum (not shown) is also generally included within the lamp envelope of said conventional lamp construction. A frit glass coating 28 according to the present invention has been fired on the exterior surface of said lamp glass envelope.

Representative glass frit compositions for use as the fired coating in the above illustrated lamp embodiment are reported in Table I below along with alternative glass frits according to the present invention suitable for electrostatic deposition on the inner bulb wall of the lamp glass envelope. As will be noted from the overall reported glass frit compositions, the glass compositions in examples 1 and 4 provide a glossy transparent fired coating as distinct from the opaque optical nature of the glass frits reported in the remaining examples. As is further common in glass technology, said glass compositions are reported in terms of oxides as calculated from the batch starting materials. Although there may be minor differences between the glass composition as calculated in this conventional manner from batch constituents and any actual glass composition obtained therefrom, both compositions will essentially be the same. There is only slight volatilization of the batch constituents in the present glass composition during melting such as by some loss of fluorine, boric oxide, and alkaline metal oxides that is to be expected. Consequently, the present invention contemplates a frit glass composition having the same composition as calculated from the starting batch formulation.

TABLE I

| | #1 | #2 | #3 | #4 | #5 | #6 | #7 | #8 | #9 | #10 |
|---|---|---|---|---|---|---|---|---|---|---|
| ZnO | 10% | 20% | 11% | 14% | 14.4% | 15% | 14.4% | 11.8% | 10% | 7% |
| $SiO_2$ | 19 | 8.5 | 16 | 20 | 17.4 | 17 | 17.4 | 14.3 | 11.3 | 8 |
| $B_2O_3$ | 18 | 17.5 | 15 | 18 | 18.2 | 18 | 18.2 | 14.9 | 12 | 9 |
| $Al_2O_3$ | 2 | — | 1 | — | — | — | — | — | — | 1 |
| $Nd_2O_3$ | 30 | 36 | 36 | 36 | 40 | 40 | 40 | 50 | 60 | 70 |
| $Na_2O$ | 2 | 1.6 | 2 | 2 | 1.5 | 2 | 1.5 | 1.5 | 1.3 | 1 |
| $K_2O$ | 8 | 6.4 | 7 | 6 | 5.5 | 5 | 5.5 | 5.5 | 3.3 | 2.5 |
| BaO | 0.6 | 5 | 1.6 | — | — | — | — | — | — | — |
| CaO | 4.4 | — | 4.4 | — | — | — | — | — | — | — |
| $ZrO_2$ | 3 | 2 | 3 | 2 | 1 | 1 | 0.5 | — | — | — |
| $TiO_2$ | — | — | — | — | — | — | 0.5 | — | — | — |
| F | 3 | 3 | 3 | 2 | 2 | 2 | 2 | 2 | 2.1 | 1.5 |
| EXP. COEFF ($\times 10^{-7}$/°C.) | 90.8 | 93.6 | 93.7 | 80.3 | 79.9 | — | 84.4 | 84.1 | | — |
| GLOSS RATING[1] | 2 | 3 | 3 | 1 | | | | | | |
| OPACITY RATING[2] | 1- | 3 | 3 | 1- | | | | | | |

[1]Gloss Rating - 1 high gloss 3 low gloss
[2]Opacity Rating - 1 low opacity 3 high opacity For the most part, it can be noted from the foregoing table that the glass compositions in examples 1 and 4 provide a glossy and clear coating when fired on a lamp glass envelope. In contrast thereto, the remaining glass compositions reported in the foregoing table are generally not suitable as fired on enamel coatings but are suitable for electrostatic deposition are previously disclosed to provide a light diffusing coating on the interior surface of the lamp glass envelope. A neodymium oxide content in the latter glass frits of 40 weight percent or greater has been found to produce optical opacity in the fired coating along with a tendancy to devitrify when these compositions are melted. For example, the fired coating prepared with the glass frit in example 8 not only required more critical firing conditions but produced an opaque bulb appearance as compared with the frit glass compositions containing neodymium oxide in proportions no greater than 40 weight percent.

It will be apparent from the foregoing description that a novel frit glass composition provides a coating medium for electric lamps to absorb light in the green and yellow wavelength region of the visible spectrum. It will also be apparent that minor variations in said glass compositions other than those above specifically disclosed are included within the scope of the present invention. It is intended to limit the present invention, therefore, only by the scope of the following claims.

What I claim as new and desire to secure by United States Letters Patent is:

1. An electric lamp which includes a light transparent glass envelope, a visible light source located within said envelope, and a coating which contains neodymium oxide melted into a transparent vitreous frit which is deposited on the surface of said envelope to absorb light emitted by said light source selectively in the green and yellow wavelength region of the visible spectrum.

2. An electric lamp as in claim 1 having an incandescent filament located within the glass envelope and with said coating being on the outer surface of said glass envelope.

3. An electric lamp as in claim 2 wherein the glass envelope is formed with soda-lime glass and the vitreous frit has been fired on the outer surface of said glass envelope.

4. An electric lamp as in claim 1 having an incandescent filament located within a glass envelope with said coating comprising a powdered vitreous frit containing neodymium oxide having been electrostatically deposited on the inner surface of said glass envelope.

5. An electric lamp as in claim 4 wherein said coating comprises a mixture of said vitreous frit with an inorganic particulate filler.

6. An electric lamp as in claim 5 wherein the glass envelope is formed with soda-lime glass.

7. An incandescent lamp comprising a sealed soda-lime glass envelope, a pair of lead-in wires hermetically sealed within said envelopes, and a resistive filament connected to said lead-in wires, the improvement which consists of a glossy coating of a transparent vitreous frit containing neodymium oxide being fired on the outer surface of said glass envelope to absorb light selectivity in the green and yellow wavelength region from the radiation that is being emitted by the resistive filament without producing significant reduction in the remaining transmitted visible light.

8. An incandescent lamp as in claim 7 wherein the vitreous frit is a zinc borosilicate glass containing neodymium oxide.

9. An incandescent lamp as in claim 8 wherein the vitreous frit composition comprises in approximate weight percent: 10–20 ZnO, 8–20 $SiO_2$, 15–20 $B_2O_3$, 0–2 $Al_2O_3$, 30–40 $Nd_2O_3$, 1–2 $Na_2O$, 6–8 $K_2O$, 0–5 BaO, 0–5 CaO, 1–3 $ZrO_2$, and 1–3 F except for residual impurities and refining agents.

10. An incandescent lamp comprising a sealed soda-lime glass envelope, a pair of lead-in wires hermetically sealed within said envelope, and a resistive filament connected to said lead-in wires, the improvement which consists of an electrostatically deposited coating on the inner surface of said glass envelope to absorb light in the green and yellow wavelength region of the spectrum without reducing the light output of said lamp more than approximately 15%, said coating comprising a physical mixture of a vitreous frit containing neodymium oxide dispersed therein with silica powder.

11. An incandescent lamp as in claim 10 wherein the silica powder contains diatomaceous silica and a light refractive particulate material selected from the group consisting of alumina, silica, aluminosilica, calcium carbonate, and mixtures thereof.

12. An incandescent lamp as in claim 10 wherein the vitreous frit is a zinc borosilicate glass containing neodymium oxide.

13. An incandescent lamp as in claim 10 wherein the vitreous frit composition comprises in approximate weight percent: 7–15 ZnO, 8–18 $SiO_2$, 9–19 $B_2O_3$, 0–2 $Al_2O_3$, 40–70 $Nd_2O_3$, 1–2 $Na_2O$, 2–6 $K_2O$, 0–1 $TiO_2$, 0–1 $ZrO_2$, and 1–3 F except for residual impurities and refining agents.

* * * * *